United States Patent [19]

Farber

[11] 4,137,663

[45] Feb. 6, 1979

[54] COMPOSITE BREECH PLUG FOR BLACK POWDER GUNS

[75] Inventor: Leland A. Farber, Salt Lake City, Utah

[73] Assignee: Browning Arms Company, Morgan, Utah

[21] Appl. No.: 869,319

[22] Filed: Jan. 13, 1978

[51] Int. Cl.[2] ..... F41C 21/00

[52] U.S. Cl. ..... 42/51; 29/1.1; 42/75 B; 42/76 R

[58] Field of Search ..... 42/51, 83, 76 R, 75 B, 42/75 A; 29/1.1

[56] References Cited

U.S. PATENT DOCUMENTS

| | | | |
|---|---|---|---|
| 15,292 | 7/1856 | Halsey | 42/51 |
| 72,063 | 12/1867 | McCulloch | 42/51 |
| 3,451,154 | 6/1969 | Goble | 42/51 |
| 4,065,866 | 1/1978 | Eguizabal | 42/51 |

*Primary Examiner*—Charles T. Jordan
*Attorney, Agent, or Firm*—Trask & Britt

[57] ABSTRACT

A breech plug for sealing the breech end of black powder guns is constructed of two pieces. The first piece is an inner plug which threadedly engages internal threads at the breech end of the barrel and creates a bore seal. The second piece is an outer housing adapted to mate with the inner plug and to effect alignment with the barrel flat sides and barrel breech end. An assembly technique utilizing this composite breech plug greatly simplifies the machining procedures and reduces the cost normally associated with producing high quality black powder guns with a full hook breech plug.

11 Claims, 6 Drawing Figures

COMPOSITE BREECH PLUG FOR BLACK POWDER GUNS

BACKGROUND OF THE INVENTION

1. Field

This invention relates to black powder guns and provides improved manufacturing techniques and components. Specifically, this invention provides a means for incorporating improved technology in black powder guns which retain traditional styling and function. More specifically, this invention pertains to a composite breech plug of the full hook type and manufacturing methods involving its use.

2. State of the Art

There has recently been a resurgence in the popularity of black powder guns, particularly smooth bore and rifled stocked guns. Modern enthusiasts of black powder guns generally desire pieces of traditional styling and action. Traditionally, high quality black powder guns have included a full hook breech plug adapted to interlock with a tang carried by the stock. The traditional black powder gun barrel is octagonal and the same octagonal pattern is carried through the exposed portion of the breech plug and tang. It is imperative, from an esthetic standpoint, that the flats of the exposed portion of the breech plug match the external flats of the remainder of the barrel, that the barrel breech end and breech plug be aligned, and that the breech plug flats and hook be aligned with the tang.

The conventional method of fitting a breech plug to a black powder gun is to first manufacture a one-piece plug. Such a plug includes a threaded extension, adapted for insertion into the barrel, and a main body, adapted to extend to the rear of the barrel. The main body includes external octagonal flat sides, and a full hook projecting from its rear surface (tang face). The threaded extension is screwed into a counter bore at the breech end of the barrel until the flats on the breech plug and barrel, respectively, are precisely lined up with each other and a gas seal is developed between the breech plug and barrel. It has been necessary to time the external threads of the plug with the internal threads of the barrel. Otherwise, when the flats are properly aligned, either (1) the breech plug may not be seated with sufficient torque to develop a proper gas seal or (2) unacceptable stresses may be developed at the notch point created by the threads of the plug, since those threads are in tension.

It is important that the plug create both a shoulder match line and a bore seal. By "match line" is meant that the flats of the barrel are in registration with the flats of the main body of the breech plug. The bore seal is effected at the interface between the forward end of the breech plug and the counter bore of the barrel. The shoulder match line is effected at the extreme breech end of the barrel at the interface between the barrel and the breech plug. It has been necessary to hand qualify one or the other of these surfaces to meet the standards of quality arms. In practice, hand qualification is so expensive that it is only performed in the case of very expensive firearms. Accordingly, the usual practice is to accept a small gap at the bore in production rifles.

Several problems are commonly encountered with breech plugs turned to effect a shoulder match line while aligning the flats (creating a match line). The threads are inherently put in tension. Accordingly, stress is translated to the notch point at the threaded extension of the plug. Firing the gun puts additional force on this notch area, which may cause the plug to fail. In addition, gases tend to blow back through the threads because of the lack of a proper bore seal, causing erosion and further weakening at the notch point. Eventually the shoulder seal can be eroded away. Moreover, the threads are often destroyed so that it is not practical to remove the plug from the barrel, which defeats the initial purpose of a quality full hook breech gun. Another dangerous condition develops as unburned residue accumulates in the gap at the bore. This residue creates a "fire ring" which can causes preignition of a fresh charge of powder.

The conventional method for making gun barrels also inherently causes difficulties in fitting a full hook breech plug. Normally, the barrel is drilled from its muzzle end, and the drill inevitably runs out at the breech with a tolerance of about 0.001 per inch of barrel length. Accordingly, in a 30 inch barrel, the caliber bore may be 0.030 inches off center at the breech end. This "bore run-out" is random, and makes it impossible to use standard breech plugs. Two methods have been used to fit breech plugs to barrels of random bore run-out, both of which are quite expensive. The first of these is to install the breech plug and then mill the external flats and tang hook on the breech plug with reference to the flats and breech end on the barrel. The other method is to drill an oversized barrel blank and then machine the barrel flats with reference to the previously drilled hole.

The high cost of machining operations necessitates that present day techniques for producing breech plugs include investment casting. Investment cast breech plugs oftentimes have structural defects that would cause them to fail in use, particularly in the area where the threaded extension joins the main body. Therefore, they are routinely x-rayed so that bad castings may be rejected. Also, secondary machining of timed threads, and selection of casting metals for strength properties and heat treating characteristics is quite expensive.

In summary, there has been a longstanding need for a breech plug assembly and fitting procedure which avoids the annoying, costly, and dangerous problems of the prior art while providing high quality black powder firearms. There is also a need for increased interchangeability of parts.

SUMMARY OF THE INVENTION

The present invention provides a composite breech plug and a method for manufacturing and fitting the plug to a barrel. The method permits use of pre-finished, octagonal barrel stock drilled from the muzzle end with normal production tolerance. It also permits the use of a high strength prefinished low cost inner plug and a low cost precision investment cast outer housing. The outer housing need not be x-rayed, nor need it be a high strength neat treated steel.

The composite plug of this invention includes an inner plug member which may be turned to threadingly engage a counter bore at the breech end of the barrel until it effects a tight bore seal. The bore seal is effected at the inner end of the plug where it abuts a shoulder defined by the bottom of the counterbore and the caliber bore. The threads of the inner plug are thus placed in compression so that the point of greatest stress is at the plug end in the barrel, (typically of cold rolled alloy steel) rather than in the breech plug (typically cast) as is presently the practice. Moreover, compression stresses on the threads are distributed uniformly along the threads, thereby avoiding a notch point. An unthreaded portion of the inner plug projects from the breech of the barrel. The barrel with the inner plug installed may be mounted in a lathe, referenced to the barrel flats, and turned concentric to the barrel flats. In this fashion, barrels with random bore run-out are fitted with standard inner plugs and then customized to the barrel with a relatively inexpensive lathe operation.

A second member of the composite breech plug is an outer housing which mates with the turned down, unthreaded portion of the inner plug. This housing includes the traditional external flats which correspond to the external flats of the barrel, a breech face to match with the breech end of the barrel, and a tang hook to match with the tang. The breech face and tang hook may be precision machined. This housing is fitted over the inner plug with its flats precisely positioned in registration with the barrel flats and barrel breech end. It is then anchored tight in place against the shoulder formed at the breech of the barrel thereby effecting a precision match line without the need for hand qualification. The outer housing may be anchored by silver soldering to the inner plug; ideally, the entire perimeter between the inner plug and outer housing members is filled with silver solder to assure that the perimeter of the flash hole, which is subsequently drilled through the members, will be gas sealed.

The foregoing techniques avoid all of the problems heretofore noted in connection to the prior art. Ideally, the barrel is pre-finished from octagonal bar stock, without secondary filling of the flats. The inner plug is pre-machined from high strength round stock of the same material normally used for gun barrels, such as 1137 steel. The outer housing, which includes the breech hook may be cast from a steel, which has been selected for casting and machining properties rather than strength and heat treating characteristics. Moreover, the outer housing member is a completely interchangeable part. The custom fitting and hand qualifying required by the prior art is avoided by the expedient of machining the inner plug concentric with the barrel flats. A blind hole in the outer housing mates with the machined portion of the inner plug, and is itself concentric with the barrel flats of the outer housing. A superior gas seal is effected at the caliber bore without the creation of any notch points or stress concentrations such as are inherent in the prior art. The housing and barrel breech end match line, and the tang hook is fit to the tang without extensive hand work. The methods of this invention are compatible with the use of production run pre-machined and pre-cast parts, thereby avoiding many of the hand qualifying costs of the prior art.

BRIEF DESCRIPTION OF THE DRAWINGS

In the drawings, which illustrate what is presently regarded as the best mode for carrying out the invention.

DESCRIPTION OF THE ILLUSTRATED EMBODIMENT

Figure 1:
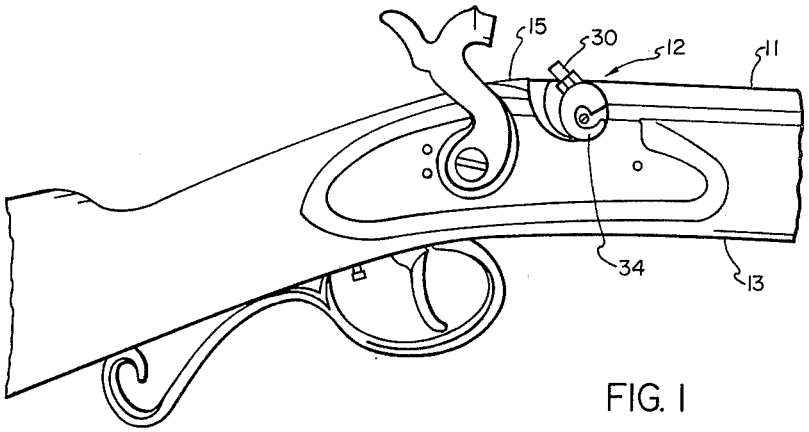
FIG. 1 is a fragmentary view in side elevation showing a barrel with a breech plug mounted to the stock of a black powder gun.
Figure 3:
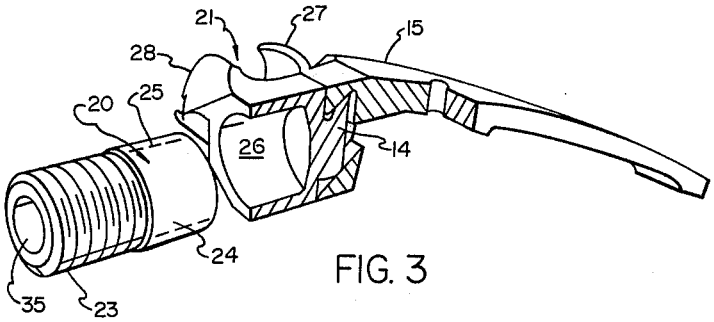
FIG. 3 is a fragmentary exploded view, partially in perspective and partially broken away, to show the members of the composite breech plug of the invention and their association with the tang of a black powder gun stock.
Figure 5:
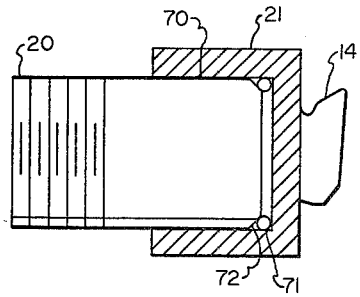
FIG. 5 is a view in cross-section of the composite breech plug assembly of this invention just prior to soldering.

Referring to FIG. 1, a conventional octagonal wrought steel barrel 11 fitted with a breech plug 12 of this invention is mounted in a stock 13 by interconnecting a hook 14 (see FIG. 3) into a tang 15 anchored to the stock 13. As best illustrated by FIG. 3, the breech plug of this invention includes an inner plug 20 and an outer housing 21. The inner plug includes a threaded portion 23 and an unthreaded portion 24. The unthreaded portion 24 is shown slightly oversized to provide for machining to the finished size indicated by phantom lines 25. Sufficient excess metal is provided to allow for the tolerance in the caliber bore run-out through the barrel 11. The outer housing 21 is provided with a pre-drilled or pre-cast blind hole 26 slightly larger than the finished diameter of the unthreaded portion 24 of the inner plug 20. The housing 21 includes, besides the full hook 14, metal projections or bosses 27 and 28 to accommodate a nipple hole, flash hole, and clean-out plug, respectively. The nipple 30 may be seen installed in FIGS. 1 and 4. The flash hole 31 is visible in FIG. 4 as viewed from inside the firing chamber 35 of the breech plug 20. The clean-out hole plug 34, which intersects the flash hole, is visible in FIG. 1.

Figure 2A:
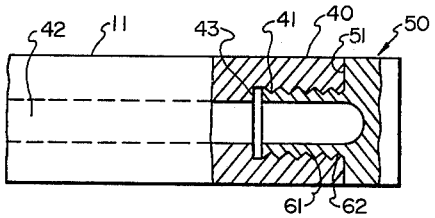
FIG. 2 shows a comparison in cross-section of the seal created by a typical breech plug of the prior art (FIG. 2A) and that of the invention (FIG. 2B)
Figure 2B:
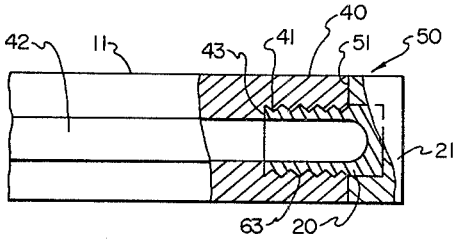
Figure 4:
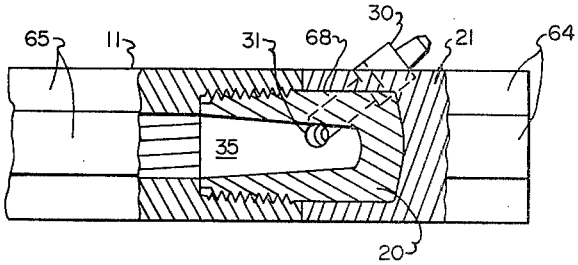
FIG. 4 is a fragmentary view partially in section showing the arrangement of flash hole, clean-out plug, and nipple in association with the composite breech plug of this invention.

Referring now to the two views of FIG. 2, the advantages of the claimed construction over the typical prior art construction is apparent. These figures show the breech end 40 of the barrel 11 of a black powder gun. A counter bore 41 is provided at the breech end 40 to receive a breech plug assembly, designated generally 50. The prior art breech plug assembly of FIG. 2A is of conventional construction, while the assembly 50 of FIG. 2B is comprised of the two components 20, 21 illustrated in FIG. 3. A shoulder 43 is defined between the caliber bore 42 and counter bore 41. A second shoulder 51 is defined at the terminus of the breech end 40 of the barrel 11. As pointed out previously herein, it is essential that a gas tight seal be effected at the breech end 40 of the barrel 11 and highly preferred that this gas tight seal be effected at the bore shoulder 43. Except in very expensive, elaborately hand tooled and qualified firearms, a gap has been permitted at the bore shoulder 43 in order to insure a match line at the breech shoulder 51. As a consequence, the threads 61 of the prior art plug (FIG. 2A) have inevitably been placed into tension, creating a stress concentration at the notch point 62. By contrast, as may be seen from FIG. 2B, the present invention avoids these difficulties by turning the inner plug 20 to a predetermined torque. This procedure effects a gas tight bore seal at the shoulder 43 and places the threads 63 in compression. The housing 21 is then placed over the inner plug 20 to effect a match line at the breech shoulder 51. Following this procedure, it is an easy matter to assure that the external flats 64 of the housing 21 precisely register with the external flats 65 of the barrel 11 (FIG. 4). Moreover, location of the hook 14 is unaffected by barrel characteristics. Accordingly, the barrel assemblies of this invention, including a barrel 11, inner plug 20 and outer housing 21, including hook 14, are interchangeable and need not be matched with specific tangs 15.

The practice of this invention reduces the manufacturing procedures required to produce a high quality black powder gun. An effective sealing of the breech is assured, yet the dangerous stress concentrations and gapping at the bore prevalent in the art are avoided. The manufacturing sequence of this invention is generally as follows: An octagonal barrel is pre-drilled and pre-finished according to conventional practice, and the random drift of the caliber bore 42 within standard tolerances (approximately 0.001 of an inch per inch) is accepted. A counter bore 41 is provided concentric with the caliber bore 42 at the breech end 40 of the barrel 11, and is provided with internal threads. An inner plug 20 with external threads 23 and an oversized extension 24 is pre-machined from high strength wrought material similar to that of the barrel. It is provided with an internal firing chamber 35 in the same fashion as is conventional with current black powder breech plugs. The internal plug 20 is screwed into the bore 41 to threadedly engage the internal threads thereof, effecting a gas tight bore seal at the shoulder 43. The barrel 11 is then chucked in a lathe, and the extension 24 is machined to the finished dimensions 25 concentric with the barrel flats 65. An investment cast housing 21 is mated with the inner plug 20 by fitting a pre-machined blind hole 26 over the extension 24. Usually, the void 70 between the inner plug 20 and the housing 20 is filled with soldering flux, a pre-formed solder ring 71 is fitted into a chamfer pocket 72, the external flats 64 and 65 are aligned with the inner plug and housing mated, and then the outer housing 21 is rotated approximately a half barrel flat to allow for proper re-torquing after soldering. It is highly preferred that the entire perimeter between the elements 20 and 21 be filled wtih solder 68 to maintain a tight gas seal around the flash hole 31. The flash hole is drilled after the soldering operation is completed. After the soldered breech plug has cooled, it is tightened to realign the housing flats with the barrel flats, thereby guaranteeing a gas tight bore seal, a match line at the breech end of the barrel alignment of the housing face with the breech end of the barrel and alignment of the tang hook with the barrel flats and barrel breech end.

A particular advantage of the claimed construction is that apart from the machining of the extension 24 of the inner plug 20, all components, including the plug 20, housing 21 and tang 15 may be interchangeable standard parts. That is, any housing 21 may be placed over any inner plug 20 once that plug has been machined to its finished dimensions 25. This machining operation is the only customizing feature required. Thus, all of the hand qualifying and fitting operations required by the prior art to produce a reasonably safe firearm of good appearance are avoided.

Reference herein to details of the illustrated embodiments should not be regarded as limiting the scope of the appended claims which themselves recite those features regarded as essential to the invention.

I claim:

1. A black powder gun comprising:

a barrel with external flats, a caliber bore and a counter bore at the breech end defining an internal shoulder with the caliber bore;

an inner breech plug, including an internal firing chamber, a first portion threadly engaged within said counter bore to form a gas tight bore seal at said internal shoulder and a second portion extending from the breech end and concentric with the axis of said barrel;

a breech plug housing with a hole at a first end fit over said second portion of said inner breech plug so that said first end of said housing effects a match line with the breech end of said barrel, and a tang hook extending from a second end; and a flash hole extending from said firing chamber through said inner breech plug and breech plug housing.

2. A black powder gun according to claim 1 wherein the threads of said inner breech plug are in compression.

3. A black powder gun according to claim 1 wherein said breech plug housing includes external flats in registration with the external flats of said barrel.

4. A black powder gun according to claim 1, wherein said breech plug housing includes an external tang hook in registration with the external flats and breech end of said barrel.

5. A black powder gun according to claim 1 wherein the space between said inner breech plug and said housing around the perimeter of said flash hole is sealed gas tight.

6. A black powder gun according to claim 2 wherein the space between said inner breech plug and said housing around the perimeter of said flash hole is sealed gas tight by means of a solder joint; the housing has external flats in registration with the external flats of said barrel; and the external housing has a tang hook in registration with the external flats and breech end of said barrel.

7. A method for constructing a black powder gun barrel assembly which includes the steps of:

drilling a caliber bore in a length of octagonal barrel stock from the muzzle end to produce a barrel;

providing a counter bore in the breech end of said barrel concentric with said caliber bore;

providing an inner breech plug, including a firing chamber, in threaded engagement within said bore to effect a gas tight bore seal at the breech end of the caliber bore; leaving a portion of said plug extending from the breech end of said barrel;

machining the extending portion of said inner breech plug concentric with the exterior surface of said barrel;

providing a housing with a hole at one end in mating relationship with said machined extending portion of said inner breech plug; and anchoring said housing to said inner breech plug in sealing relationship, thereby forming a gas tight flash hole, and match line with the barrel breech end.

8. A method according to claim 7, wherein said housing includes exterior flats, corresponding to the exterior flats of said octagonal barrel stock, and said housing is fixed to said breech plug with the exterior flats of the housing in registration with the exterior flats of said barrel.

9. A method according to claim 7, wherein said outer housing includes an exterior tang hook, corresponding to the exterior flats and breech end of said octagonal barrel stock, and said housing is fixed to said inner plug with the exterior tang hook of the housing in registration with the exterior flats and breech end of said barrel.

10. A method according to claim 7 wherein the void between the housing and plug is substantially filled with solder flux, solder is inserted between said plug and said housing, the said flats are registered, the outer housing is rotated approximately half of a barrel flat, the plug and housing are heated to melt said solder to effect a gas tight solder connection, and a flash hole is drilled through said housing and plug to said firing chamber.

11. A method according to claim 10 wherein after cooling, said breech plug assembly is rotated approximately half a barrel flat thereby to guarantee effective said bore seal, align said breech housing flats with said barrel flats, align said breech housing face with said barrel end, and align said breech housing tang hook with said barrel flats and said barrel breech end.

* * * * *